US007958648B1

(12) United States Patent
MacConnell

(10) Patent No.: US 7,958,648 B1
(45) Date of Patent: Jun. 14, 2011

(54) WALL MARKING DEVICE AND METHOD OF USE THEREOF

(76) Inventor: Carey MacConnell, Lakeland, FL (US)

( * ) Notice: Subject to any disclaimer, the term of this patent is extended or adjusted under 35 U.S.C. 154(b) by 0 days.

(21) Appl. No.: 12/569,493

(22) Filed: Sep. 29, 2009

Related U.S. Application Data

(60) Provisional application No. 61/194,518, filed on Sep. 29, 2008.

(51) Int. Cl.
*B25H 7/00* (2006.01)

(52) U.S. Cl. ..... 33/613; 33/666

(58) Field of Classification Search ..... 33/613, 33/644, 528, 666–671
See application file for complete search history.

(56) References Cited

U.S. PATENT DOCUMENTS

| | | | | |
|---|---|---|---|---|
| 3,393,963 | A | 7/1968 | Nadai | |
| 4,035,090 | A | 7/1977 | Bavaveas | |
| 4,512,084 | A * | 4/1985 | Lieberman | 33/574 |
| 5,222,823 | A | 6/1993 | Conforti | |
| 5,927,880 | A | 7/1999 | Allison et al. | |
| 6,077,898 | A | 6/2000 | Flores | |
| 6,574,880 | B2 * | 6/2003 | Lombardo | 33/666 |
| 6,653,265 | B2 | 11/2003 | Rossi et al. | |
| 6,952,887 | B2 * | 10/2005 | Muchnik | 33/666 |
| 7,107,980 | B1 | 9/2006 | Craig | |
| 7,234,245 | B2 * | 6/2007 | Tatum | 33/666 |
| 7,253,140 | B2 | 8/2007 | Rossi et al. | |
| 7,293,925 | B1 * | 11/2007 | Sanseviero | 33/666 |
| 7,350,312 | B1 * | 4/2008 | Grillo | 33/613 |
| 2003/0182815 | A1 * | 10/2003 | Carlson, II | 33/566 |
| 2004/0098875 | A1 * | 5/2004 | Gould | 33/613 |
| 2004/0216319 | A1 * | 11/2004 | Muchnik | 33/666 |
| 2006/0196069 | A1 * | 9/2006 | Groepper | 33/613 |
| 2008/0263882 | A1 * | 10/2008 | Knowlton | 33/528 |
| 2009/0188121 | A1 * | 7/2009 | Rabin | 33/332 |

* cited by examiner

*Primary Examiner* — Yaritza Guadalupe-McCall
(74) *Attorney, Agent, or Firm* — Montgomery Patent and Design; Robert C. Montgomery

(57) ABSTRACT

A device that provides an accurate means to mark a wall surface to aid in hanging a suspended object is herein disclosed, comprising an adhesive strip with small sealed plastic bubbles filled with dye or ink on a first side. At least one (1) ink bubble is positioned thereat a corresponding mounting aperture portions of the suspended object. The ink bubbles rupture under a small amount of applied pressure, thereby marking the wall surface. A second side of the marking device comprises adhesive, thereby allowing the device to be applied thereto the back surface of the suspended object to be hung on a wall, specifically locating where the mounting hardware needs to be installed. The marking device is then removed and the suspended object is secured by driving fasteners and other supporting hardware, using the indicating ink mark. Alternatively, the first side comprises identifying markings such as measurements, instructions, or advertising indicia.

12 Claims, 4 Drawing Sheets

WALL MARKING DEVICE AND METHOD OF USE THEREOF

RELATED APPLICATIONS

The present invention was first described in and claims the benefit of U.S. Provisional Application No. 61/194,518 filed Sep. 29, 2008, the entire disclosures of which are incorporated herein by reference.

FIELD OF THE INVENTION

The present invention relates generally to methods for leveling picture frames and other similar wall-hung items, and in particular, to a device consisting of double sided tape with an integral ink marking means for indicating the correct placement of nails in a wall in order to ensure the even hanging of a picture frame or other similar item.

BACKGROUND OF THE INVENTION

Wall hangings such as framed paintings and pictures are one of the most common types of home decorations. One (1) of the most important aesthetic aspects of such decorations is that they are hung in a level manner, with the straight edges being parallel or perpendicular to the ground. Correctly placing wall hanging hardware such as nails or hooks in order to achieve a perfectly level decoration is a very difficult task. In addition, the removal and replacement of such hanging hardware in order to readjust a decoration can result in multiple holes in the wall and permanent damage to the house. While some people may use ink or pencil markings to indicate the proper location for hanging hardware placement, the proper placement of such markings is also difficult to achieve.

Various attempts have been made to provide a means for the quick and accurate placement of ink markings and the like. Examples of these attempts can be seen by reference to several U.S. Pat. No. 3,393,963, issued in the name of Nadai, describes a liquid dispensing applicator. The Nadai device is designed to allow for the dispensation of ink or other similar liquid when the user applies pressure to the device by hand.

U.S. Pat. No. 7,107,980, issued in the name of Craig, describes a carpenter's marking device. The Craig device utilizes a laser system to allow the user to mark a spot on a wall that is vertically aligned with a selected spot.

While these devices fulfill their respective, particular objectives, each of these references suffer from one or more of the aforementioned disadvantages. Many such devices do not provide for simple, repeatable marking capabilities in a manner that is quick and simple. Also, many such devices which do provide for simple, repeatable marking capabilities do not provide an integral means by which to level the marks. Accordingly, there exists a need for a wall marking device with integral leveling capabilities without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means of marking a wall for the correct placement of hanging hardware in a manner which allows for accurate and level hanging of an object and in a manner which is simple, easy, and quick. Thus, the object of the present invention is to solve the aforementioned disadvantages and provide for this need.

To achieve the above objectives, it is an object of the present invention to provide a wall marking device which provides a means for accurately marking a wall surface for anticipated hanging hardware such as wall anchors, eyelets, hooks, screws, etc. The device comprises a laminated assembly including a release liner, a first adhesive layer, a substrate, a second adhesive layer, and a marking bubble.

Another object of the present invention is to provide a release liner, which comprises an easily releasable sheet preferably made of plastic film, waxed-paper, etc. The release liner is intended to allow the adhesively coupled first adhesive layer portion to remain affixed to the substrate when separated.

Yet still another object of the present invention is to provide a length of substrate preferably introduced in a roll form made of flexible material, where the substrate comprises a plurality of equidistant parallel linear perforated liens approximately one (1) inch apart. It is envisioned that the substrate will comprise a closed-cell foam or similar flexible compliant material, being approximately one-sixteenth (1/16) to one-eighth (1/8) inch thick.

Yet still another object of the present invention is to provide a first adhesive layer and a release liner, comprising an adhesive attachment means to the suspended object. The first adhesive layer and release liner are located along the entire length of an underside surface of the substrate.

Yet still another object of the present invention is to provide equally spaced perforated lines, where the perforated lines perforate through both the substrate and the release liner. The perforated lines enable the device to be easily separated into individual marking segments.

Yet still another object of the present invention is to provide each marking segment with a marking bubble, which is permanently attached to a top surface of the substrate. The marking bubble is adhesively attached to the center of the segment by means of a second adhesive layer applied between the marking bubble and the substrate.

Yet still another object of the present invention is to provide marking bubbles, which comprise pliable sealed plastic enclosures that form a protruding hemispherical shape that contains a very small volume of marking ink. It is envisioned that the marking ink will comprise a generic non-permanent ink or dye such as a vegetable dye or an equivalent marking composition.

Yet still another object of the present invention is to comprise the marking bubble of a pliable sealed plastic enclosure that is designed to rupture when subject to a small amount of compressive force. It is envisioned that force applied between the suspended object and the wall surface will release the internal marking ink upon the wall surface.

Yet still another object of the present invention is to be introduced in rolls or strips that allow for a variety of convenient lengths and widths being suitable to various applications and adaptable for use with a corresponding dispensing unit similar to a common tape dispenser. It is also envisioned that the device may be introduced with identifying markings printed upon it, such as graduation markings, advertising indicia, etc.

Yet still another object of the present invention is to provide a method of utilizing the device that provides a unique means of marking a wall for the correct placement of hanging hardware in a manner which allows for accurate and level hanging of an object and in a manner which is simple, easy, and quick.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
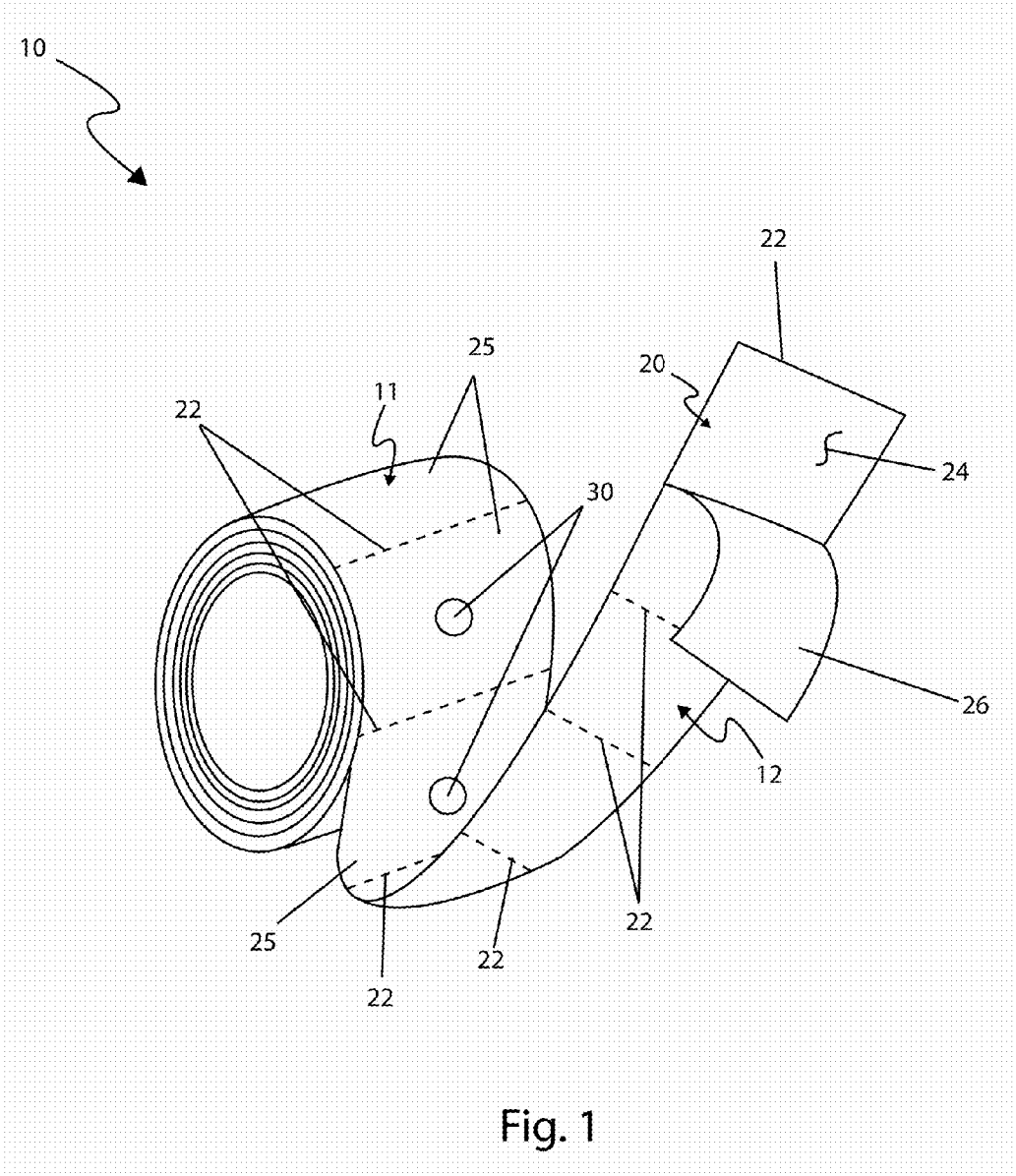
FIG. 1 is a perspective view of a wall marking device 10, according to a preferred embodiment of the present invention.

10 wall marking device
11 first side
12 second side
20 substrate
22 perforated line
24 first adhesive layer
25 marking segment
26 release liner
30 marking bubble
32 marking ink
50 second adhesive layer
100 residence
105 wall surface
110 suspended object
115 object target

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a wall marking device (herein described as the "device") 10, which provides a means for accurately marking a wall surface 105 in preparation for anticipated hanging hardware such as wall anchors, eyelets, hooks, screws, or the like, to be used to mount suspended objects 110 such as, but not limited to: floating shelves, shadow boxes, or the like thereupon a wall 105. In use, a second side 12 of the device 10 is adhesively attached thereto a back surface of the suspended object 110 such that a first side 11 comprising a marking bubble 30 filled with an ink 32 is facing outwardly. The suspended object 110 is then temporarily positioned upon the wall 105 by a user; a small amount of perpendicular force is applied thereto the suspended object 110; and, the device 10 subsequently deposits an ink mark 32 thereupon said wall 105 thereat an accurate and leveled location for the hanging hardware to be affixed thereto said wall surface 105.

Referring now to FIG. 1, a perspective view of the device 10, according to the preferred embodiment of the present invention, is disclosed. The device 10 comprises a length of substrate 20 preferably introduced in a roll form, and made of a flexible material, further comprising a plurality of equidistant parallel linear perforated lines 22 approximately one (1) inch apart. The device 10 also comprises a first adhesive layer 24 and a release liner 26 providing an adhesive attachment means thereto the suspended object 110. The first adhesive layer 24 and release liner 26 are located along the entire length of an underside surface of the substrate 20 which is envisioned to be similar to adhesive attachment means found on commercially available foam tape. A marking bubble 30 is positioned and affixed thereto the substrate 20 being centered therebetween each pair of consecutive perforated lines 22 along a front side portion of the device 10 (also see FIG. 4).

The device 10 is envisioned to be introduced in rolls or strips, thereby providing a variety of convenient lengths and widths being suitable to various applications. The device 10 may also be introduced with a corresponding dispensing unit envisioned to be similar thereto a common tape dispenser. The device 10 may also be introduced with identifying markings printed thereupon such as graduation markings, advertising indicia, or the like.

Figure 2:
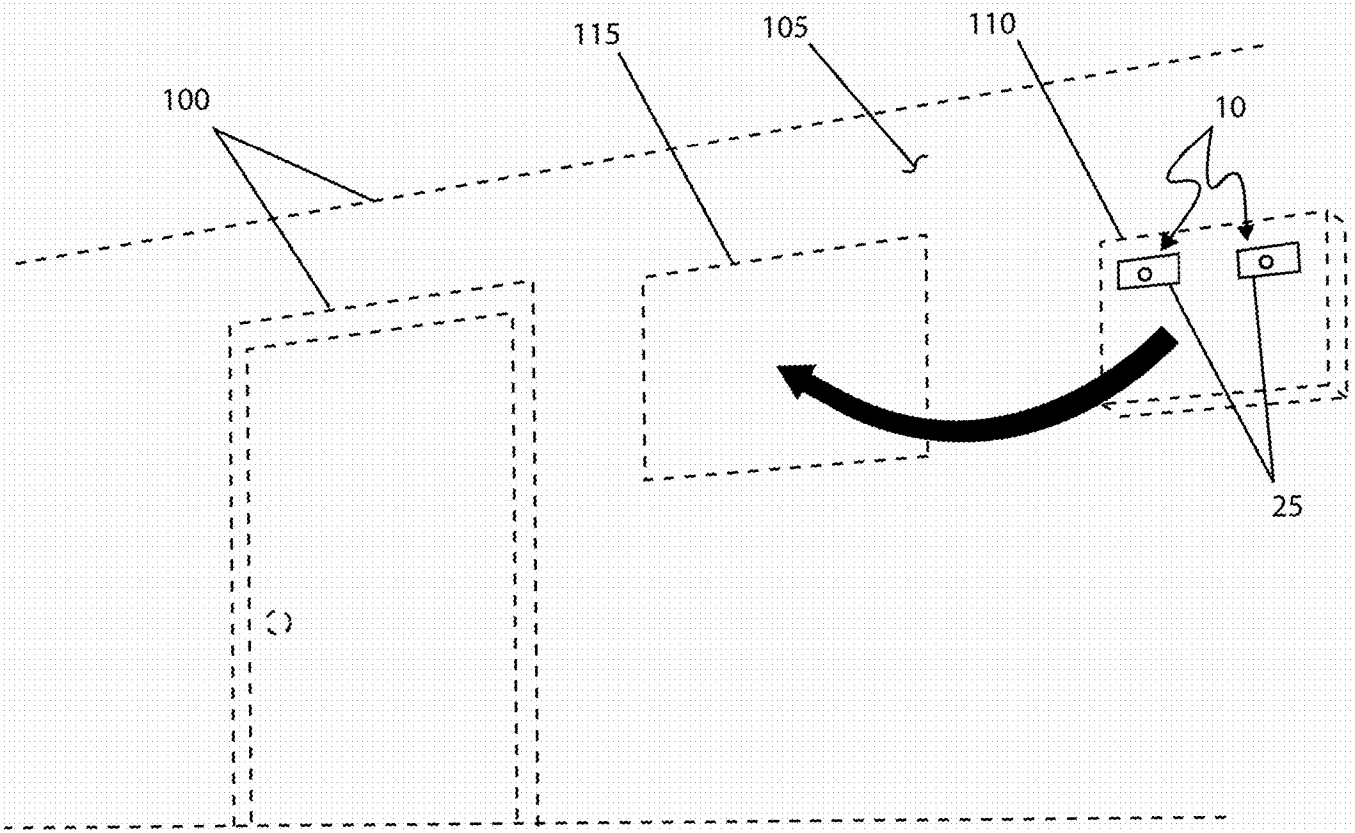
FIG. 2 is an environmental view of the wall marking device 10, according to a preferred embodiment of the present invention.

Referring now to FIG. 2, an environmental view of the device 10, according to a preferred embodiment of the present invention, is disclosed. In use, the device 10 is adhesively applied thereto a suspended object 110 thereat specific points which correspond thereto locations along a wall surface 105 where it is anticipated that hanging hardware is to be installed to support the suspended object 110. The perimeter edge of said suspended object 110 is depicted here as an object perimeter target 115 illustrated thereat a typical desired location. The device 10 and the corresponding suspended object 110 are depicted here being applied thereto a vertical interior wall portion 105 of a residence 100; however, it is understood that the device 10 may be utilized thereupon various surfaces such as, but not limited to: ceilings, exterior walls, sloped surfaces, doors, and the like, and as such should not be interpreted as a limiting factor of the device 10.

The first adhesive layer 24 portion of the device 10 provides a tacky bonding surface and is adapted to temporarily affix the device 10 thereto the back surface of the suspended object 110 such that the marking bubbles 30 are positioned coincidentally therewith a plurality of mounting aperture portions thereupon a back surface of said suspended object 110. A small amount of perpendicular force is then applied thereto the suspended object 110 which subsequently causes a portion of marking ink 32 to be deposited thereupon said wall surface 105 thereat a correct location for anticipated installation of one (1) or more hanging hardware items.

Figure 3:
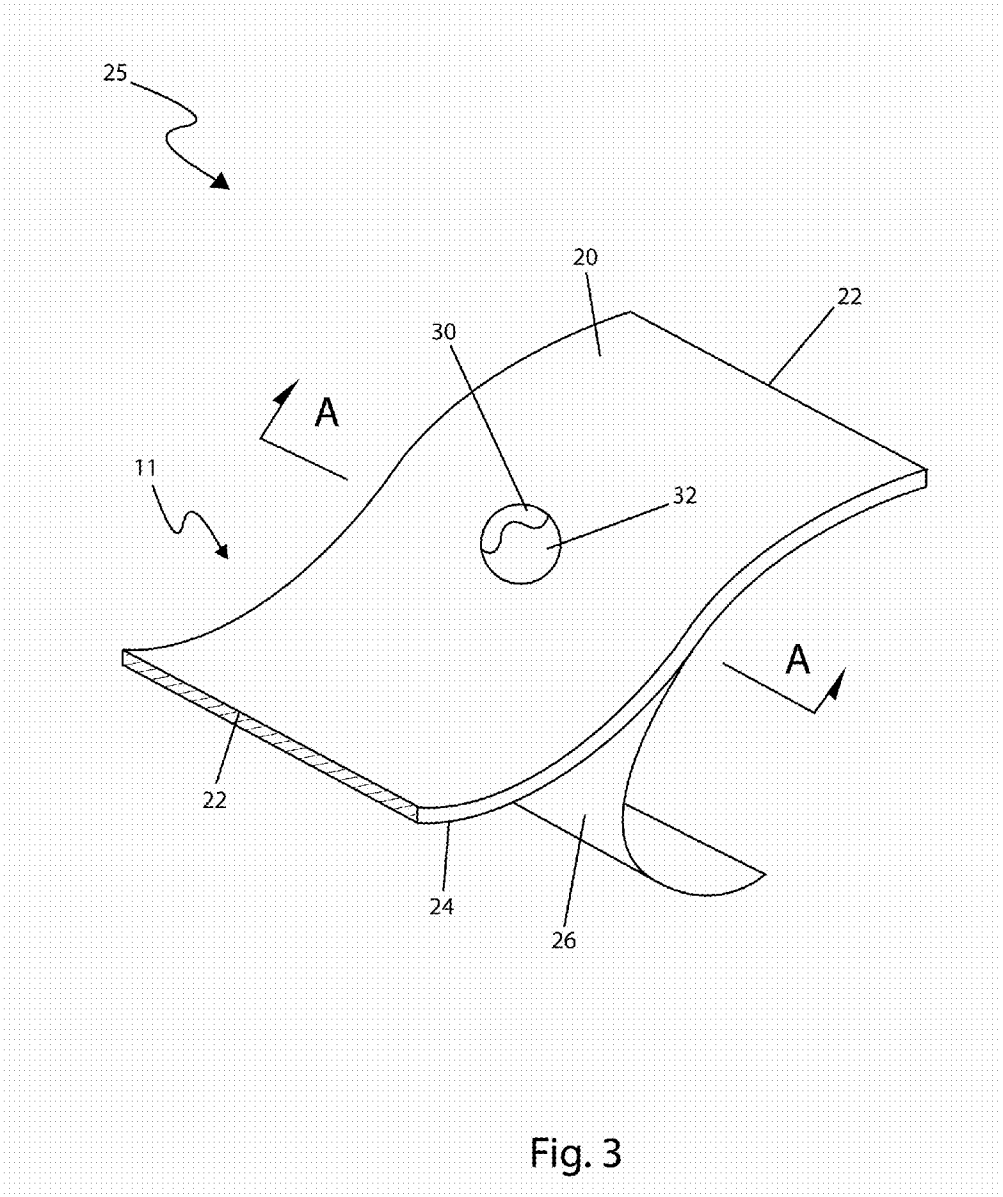
FIG. 3 is a top perspective view of a single marking segment portion 25 of the wall marking device 10, according to a preferred embodiment of the present invention; and, FIG. 4 is a section view of a marking segment portion 25 of the wall marking device 10, according to a preferred embodiment of the present invention.

Referring now to FIG. 3, a top perspective view of a marking segment 25 of the device 10, according to the preferred embodiment of the present invention, is disclosed. The equidistantly-spaced perforated lines 22 are envisioned to perforate therethrough both the substrate 20 and the release liner 26 enabling the device 10 to be easily separated thereinto individual marking segments 25, thereby enabling one (1) or more marking segment portions 25 of the device 10 to be used in a variety of arrangements based upon a specific geometry of the suspended object 110 to be hung on the wall 105. Each marking segment 25 comprises a marking bubble 30 permanently attached thereto a top surface of the substrate 20 using a second adhesive layer 50 being applied therebetween said marking bubble 30 and the substrate 20 being centrally located thereupon. The marking bubbles 30 comprise pliable sealed plastic enclosures which form a protruding hemispherical shape being equidistantly spaced at approximately one (1) inch intervals therebetween. Each marking bubble 30 contains a very small volume of marking ink 32 comprising a generic non-permanent ink or dye such as a vegetable dye or an equivalent marking composition. The marking bubbles 30 are designed so as to rupture when subjected thereto a small amount of compressive force therebetween the suspended object 110 and the wall surface 105, thereby releasing the internal marking ink 32 thereupon said wall surface 105.

Figure 4:
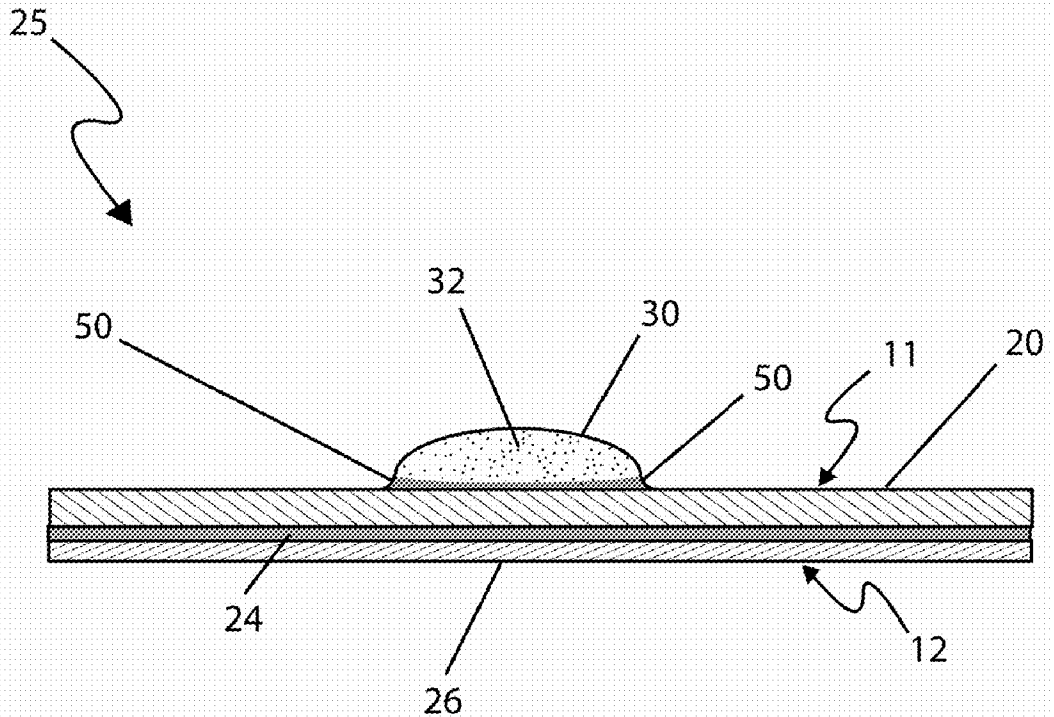

Referring now to FIG. 4, a section view of a marking segment portion 25 of the device 10, according to a preferred embodiment of the present invention, is disclosed. The device 10 comprises a laminated assembly comprising a release liner 26, a first adhesive layer, 24, a substrate 20, a second adhesive layer 50, and a marking bubble 30. The release liner 26 comprises an easily releasable sheet, preferably made of plastic film, waxed-paper, or the like, allowing the adhesively coupled first adhesive layer portion 24 to remain affixed thereto the substrate 20 when separated. In use, the release liner 26 provides a peel-off covering means which protectively remains in tact against the substrate 20 until the device 10 is ready to be applied. The substrate 20 comprises a layer of flexible closed-cell foam or similar flexible compliant material being approximately one-sixteenth (1/16) to one-eighth (1/8) inch thick. The first 24 and second 50 adhesive layers are envisioned as utilizing common flexible adhesive compositions having suitable adhering and releasing characteristics being common in the industry.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 through 3.

The method of utilizing the device 10 may be achieved by performing the following steps: obtaining a desired suspended object 110 to be hung thereon a wall 105, ceiling, door, or the like, such as a floating shelf, a shadow box, a shelving unit, or the like; determining an object target area 115 thereupon a wall surface 105 where a user desires to hang the suspended object 110; unrolling a desired length of the device 10 comprising a required number of marking segments 25; locating the mounting apertures thereon the back surface of the suspended object 110 to be hung; tearing along the perforated line 22 to remove and apply a single marking segment 25; peeling the release liner 26 therefrom the marking segment 25 to expose the first adhesive layer 24; aligning the marking bubble portion 30 directly over top of a mounting aperture portion of the suspended object 110; adhesively attaching said marking segment 25 thereon the back surface of the suspended object 110 such that the marking bubble 30 is aligned thereover said mounting aperture; repeating an attachment of the remaining required marking segments 25 thereover remaining mounting aperture portions; positioning the suspended object 110 over the object target 115 thereon the wall surface 105 or other desired surface; leveling the suspended object 110; applying a small amount of perpendicular force thereon the suspended object 110, thereby applying a small amount of pressure thereto the marking bubbles 30; allowing the marking bubbles 30 to rupture, thereby releasing a small amount of marking ink 32 from each marking bubble 30 to correctly mark the wall surface 105; removing each spent marking segment 25 therefrom the back surface of the suspended object 110; installing mounting hardware such as hooks, screws, or the like, thereupon the wall surface 105 at each point where the marking ink 32 has been deposited; hanging the suspended object 110 therefrom the mounting hardware in an expected manner; and, benefiting from increased and improved convenience, accuracy, and time afforded a user of the present device 10.

The method of utilizing the device 10 for a suspended object 110 which does not comprise integral mounting apertures may be achieved by performing the following alternate steps: locating a top edge or lip portion of the suspended object 110; aligning a length of the device 10 along an upper back edge of the suspended object 110, thereby creating a straight line of marking bubbles 30; adhesively attaching a length of substrate 20, or a plurality of marking segments 25, thereupon the back surface of the suspended object 110; determining an object target area 115 thereupon a wall 105 where a user desires to hang the suspended object 110; positioning the suspended object 110 to be hung thereon the wall surface 105 as desired; leveling the suspended object 110; rupturing the marking bubbles 30 as previously described, thereby releasing the marking ink 32; removing the spent substrate 20 therefrom the back surface of the suspended object 110; utilizing the deposited marking ink 32 to install alternate mounting hardware such as, but not limited to: various brackets, hanging cables, custom hardware, or the like; and, hanging the suspended object 110 in an expected manner.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A wall marking device, comprising:

a linear roll comprising a plurality of marking segments;

a marking bubble filled with a marking fluid located thereon each of said plurality of marking segments; and, a separating means for separating an individual marking segment therefrom adjacent marking segments;

wherein each of said plurality of marking segments are removably attached thereto a back surface of a desired item; and, wherein said wall marking device provides a means to accurately mark a wall surface prior to hanging said desired item.

2. The wall marking device of claim 1, further comprising indicia thereupon each of said plurality of marking segments.

3. The wall marking device of claim 1, wherein each of said plurality of marking segments further comprises:

a substrate, comprising:

a first adhesive layer, comprising an entire first surface thereof said substrate; and, a second surface, wherein said marking bubble is located in a central position; and, a release liner adhesively bonded thereto said first adhesive layer;

wherein said first adhesive layer is removably attached thereto said desired item.

4. The wall marking device of claim 3, wherein said substrate further comprises a flexible compliant material.

5. The wall marking device of claim 4, wherein said substrate further comprises a thickness of approximately one-sixteenth to one-eighth inch thick.

6. The wall marking device of claim 3, wherein said marking bubble is adhesively bonded thereto said second surface with a second adhesive layer.

7. The wall marking device of claim 6, wherein said marking bubble further comprises a pliable sealed plastic enclosure forming a protruding hemispherical shape retaining said marking fluid therewithin;

wherein said marking bubble ruptures under a small amount of compressive force therebetween, thereby releasing said marking ink fluid.

8. The wall marking device of claim 1, wherein said marking fluid further comprises a non-permanent ink or dye.

9. The wall marking device of claim 1, wherein said separation means further comprise a plurality of equidistant parallel linear perforated lines.

10. The wall marking device of claim 9, wherein said separation means are approximately one (1) inch apart.

11. A method for marking a wall surface therewith a wall marking device prior to hanging a desired item comprises the following steps:

providing said wall marking device, further comprising:

a linear roll comprising a plurality of marking segments, wherein each of said plurality of marking segments further comprises:

a substrate comprising a flexible compliant material, further comprising:

a first adhesive layer, comprising an entire first surface thereof said substrate; and, a second surface; and, a release liner adhesively bonded thereto said first adhesive layer;

a marking bubble comprising a pliable sealed plastic enclosure forming a protruding hemispherical shape adhesively bonded thereto said second surface with a second adhesive layer at a central location thereon each of said plurality of marking segments;

a marking fluid therewithin said marking bubble; and, a separating means for separating an individual marking segment therefrom adjacent marking segments, comprising a plurality of equidistant parallel linear perforated lines;

providing said desired item;

determining an object target area thereupon a wall surface where said desired item is to be suspended;

unrolling a desired length of said wall marking device comprising a required number of said plurality of marking segments;

determining a location of a desired placement of hanging features on a rear side of said desired item;

separating an individual marking segment therewith said separation means;

adhesively removing said release liner therefrom said individual marking segment to expose said first adhesive layer;

aligning said marking bubble directly over top of an individual location of said desired placement of hanging features;

attaching said individual marking segment thereon said rear surface of said desired item such that said marking bubble is facing outwardly;

repeating said separating, adhesively removing, aligning, and attaching steps for a desired amount of said plurality of marking segments;

positioning said desired item over said object target area thereon said wall surface;

leveling said desired item;

applying a small amount of force thereon a front side of said desired item, thereby applying a small amount of pressure therebetween said marking bubble of each of said desired amount of said plurality of marking segments, thereby rupturing said marking bubble and releasing said marking fluid, wherein said marking fluid marks said wall surface to mark an attachment location of said hanging features on said wall surface;

removing said desired amount of said plurality of marking segments therefrom said desired item;

mounting said hanging features thereto said wall surface as marked by said marking fluid; and, hanging said desired item therefrom said hanging features mounted thereto said wall surface.

12. The method of claim 11, further comprising the alternate steps of:

locating a top edge or lip portion of said desired item;

aligning a length of said wall marking device comprising a desired length of said plurality of marking segments along an upper back edge of said desired item, thereby creating a straight line of marking bubbles; and, adhesively attaching said desired length of said plurality of marking segments thereupon the back surface of the suspended object.

* * * * *